United States Patent [19]

Miura et al.

[11] 4,436,453

[45] Mar. 13, 1984

[54] MACHINE FOR AND METHOD OF HARDENING SOFT GROUND IN DEPTHS

[75] Inventors: Mituo Miura; Yoshinori Kukino; Takumi Fujii, all of Tokyo, Japan

[73] Assignees: Takenaka Komuten Co., Ltd.; Takenaka Doboku Co., Ltd., both of Japan

[21] Appl. No.: 355,648

[22] Filed: Mar. 8, 1982

[51] Int. Cl.[3] ..... E02D 3/12

[52] U.S. Cl. ..... 405/263; 175/61; 175/73; 405/269

[58] Field of Search ..... 405/263, 269, 222, 223, 405/232; 175/24, 45, 61, 73; 173/2, 39, 44

[56] References Cited

U.S. PATENT DOCUMENTS

| | | | |
|---|---|---|---|
| 3,938,597 | 2/1976 | Richmond et al. | 175/24 |
| 4,022,284 | 5/1977 | Crow | 175/24 X |
| 4,069,678 | 1/1978 | Miura et al. | 405/263 |

FOREIGN PATENT DOCUMENTS

| | | | |
|---|---|---|---|
| 55-101618 | 8/1980 | Japan | 405/269 |
| 56-81714 | 7/1981 | Japan | 405/269 |

*Primary Examiner*—David H. Corbin

[57] ABSTRACT

Agitation shafts provided with agitation vanes at lower portions thereof are fastened rotatably to the outer circumferential surface of a support cylinder to form a soft ground hardening machine. Connecting means are provided between upper and lower portions of the support cylinder. The connect-means are adapted to be tensed and slackened for eliminating the inclination of the machine in operation. In a soft ground hardening method using this machine, the inclination thereof can be eliminated as the direction in which the machine is inserted into or withdrawn from the soft ground is measured momentarily.

5 Claims, 7 Drawing Figures

MACHINE FOR AND METHOD OF HARDENING SOFT GROUND IN DEPTHS

BACKGROUND OF THE INVENTION

1. Field of the Invention

This invention relates to a machine for and a method of hardening the soft ground in depth, and more particularly to a machine for hardening the soft ground in depths, which is capable of eliminating a deviation of a lower end portion thereof.

2. Description of the Prior Art

In order to treat the soft ground by a method of hardening the soft ground in depths, a soft ground hardening machine is used, which has an extremely large length and small width. While a deep portion of the soft ground is treated with such an elongated machine, the external force is imparted to the machine from the ground and a ship on which the machine is supported. Accordingly, the machine is liable to be inclined or bent. This makes it difficult to form a hardened wall at a high accuracy.

When the soft ground hardening machine in operation is inclined or bent, the ship from which the machine is suspended is inclined, and the elongated machine is moved forward and backward, and rightward and leftward with an upper portion thereof fixedly held, to thereby eliminate the inclination of the machine. According to the above-described method, a high restraining force is applied from the soft ground to the soft ground hardening machine after the machine has been inserted into the soft ground to a certain extent, so that it is difficult to eliminate the inclination of the machine.

SUMMARY OF THE INVENTION

An object of the present invention is to provide a machine for hardening the soft ground in depths, which is capable of being inserted into or withdrawn from the soft ground without being inclined.

Another object of the present invention is to provide a machine for hardening the soft ground in depths, which is capable of eliminating the inclination and bending of a lower end portion thereof with connecting means provided between upper and lower portion of the machine.

Still another object of the present invention is to provide a machine for hardening the soft ground in depths, which is provided between upper and lower portions thereof with connecting means capable of increasing to a great extent the rigidity of the machine with respect to the bending force applied thereto.

A further object of the present invention is to provide a method of hardening the soft ground in depths at a high accuracy with a soft ground hardening machine while eliminating the inclination of a lower end portion thereof.

The above and other objects as well as advantageous features of the invention will become apparent from the following description of the preferred embodiments taken in conjunction with the accompanying drawings.

DESCRIPTION OF THE PREFERRED EMBODIMENTS

Figure 1:
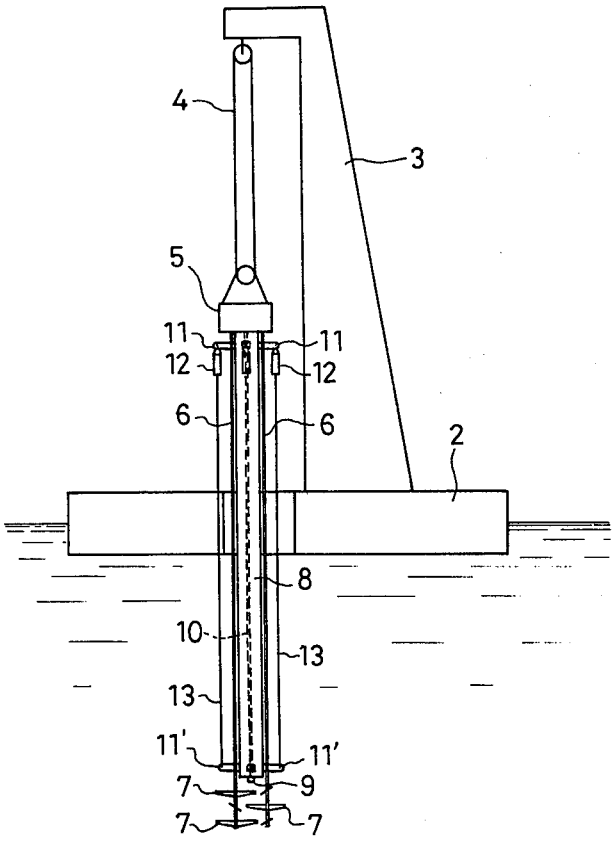
FIG. 1 is a schematic diagram of a machine as a whole for hardening the soft ground in depths according to the present invention, which is installed in a ship.
Figure 2:
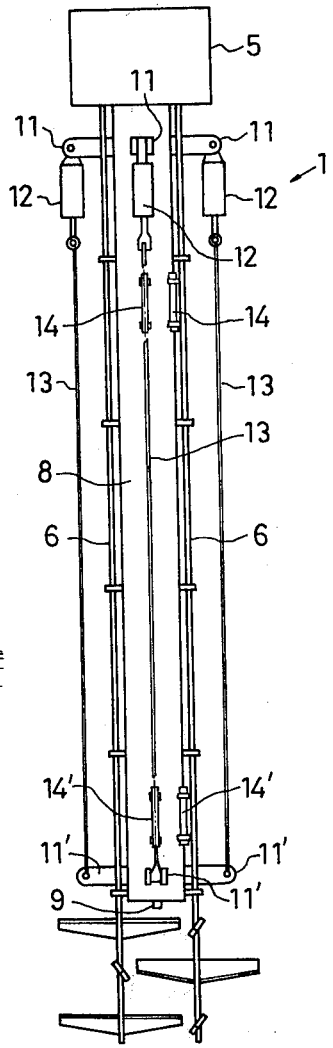
FIG. 2 is an enlarged front elevational view of the soft ground hardening machine.

The soft ground hardening machine according to the present invention will be described with reference to FIGS. 1 and 2. A machine 1 for hardening the soft ground in depths is suspended via a wire from a tower 3, which is set up on a ship 2, in such a manner that the machine 1 can be moved up and down. The machine 1 is provided under a rotary driving unit 5 therefor with a plurality of elongated agitation shafts 6, each of which has at a lower portion thereof a plurality of agitation vanes 7 attached thereto. The agitation shafts 6 are held rotatably via a bearing on a support cylinder 8, which is extended below the rotary driving unit 5, and which has so large a length that the support cylinder 8 reaches a position in the vicinity of the agitation vanes 7. A hardener supply pipe 10 is held in the support cylinder 8 in such a manner that a discharge port 9 thereof for a hardener is positioned in the vicinity of the agitation vanes 7. The hardener supply pipe 10 is communicated at an upper end portion thereof with a hardener tank (not shown).

A structure for supplying a hardener is not limited to the structure formed in the above-described manner; a structure for this purpose may be so formed that a hardener can be passed through the agitation shafts to be discharged from the lower ends thereof or the agitation vanes.

Figure 6:
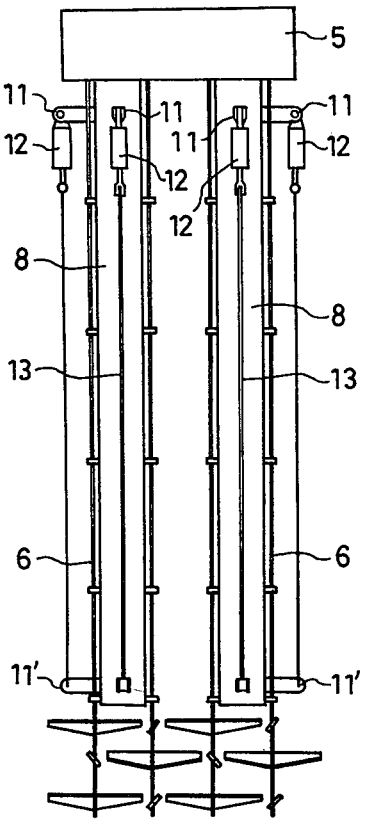
FIGS. 6 and 7 are a front elevational view and a horizontal sectional view, respectively, of the soft ground hardening machine having two support cylinders.
Figure 7:
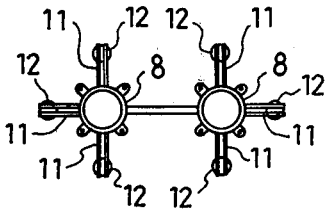

Pairs of brackets 11, 11' are provided so as to project from those positions on upper and lower end portions of the support cylinder 8 which are aligned with each other in the vertical direction, and each pair of the upper and lower brackets are joined together with a connecting means consisting of a rod, which will be described later. A total of eight brackets 11, 11' are provided generally on those sections of the outer surface of the upper and lower end portions of the support cylinder 8 which are spaced at 90° in the horizontal direction, in order to eliminate the bending of the machine 1 in the longitudinal and lateral directions. In the case of a soft ground hardening machine having two support cylinders 8 as shown in FIGS. 6 and 7, six brackets 11, 11' are provided on upper and lower portions of each of the support cylinders 8, i.e. a total of twelve brackets are provided on the two support cylinders 8. A jack 12 is supported pivotably at a base portion thereof on each of the upper brackets 11. Rods 13 or wires are connected to the lower ends of the jacks 12, and the other end of the rods 13 are fastened via pins to the lower brackets 11', which are vertically aligned with the upper brackets 11. The jacks 12 are expaned and contracted by operating a hydraulic control unit (not shown) provided on the ship 1. Measuring instruments 14, 14' for use in determining an angle of inclination and a degree of bend of the support cylinder 8 are provided in positions, which are on the outside of the upper and lower portions of the support cylinder 8, and which are opposed to the upper and lower ends of the rods 13. Each of the inclination measuring instruments is adapted to subject angles of inclination of the machine 1 in the longitudinal and lateral directions to electric conversion and transmit a signal to the ship 2.

In order to treat the soft ground by using the machine for hardening the soft ground in depths, the agitation shafts 6 are inserted thereinto as they are rotated. As the insertion of the machine progresses, it is ascertained with signals, which are transmitted continuously from the inclination measuring instruments 14, 14', that the machine is being moved perpendicularly or in a predetermined direction.

Figure 3:
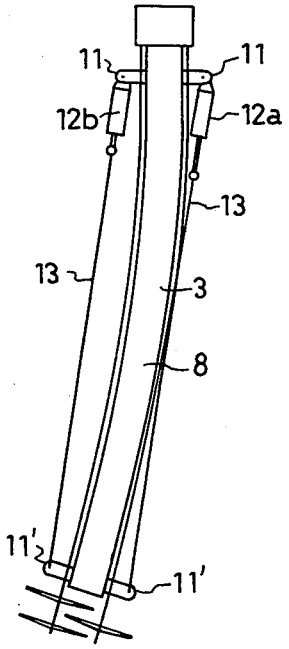
FIG. 3 is a front elevational view of the soft ground hardening machine with a lower end portion thereof inclined.
Figure 4:
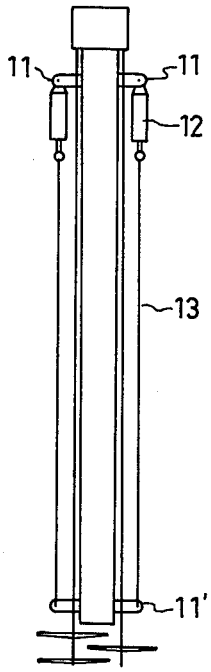
FIG. 4 is a front elevational view of the machine shown in FIG. 3, the inclined lower end portion of which has been straightened.

When a signal representative of the occurrence of the inclination of or bend in the lower end portion of the machine 1 has been received from the inclination measuring instruments 14, 14', or, for example, when the machine 1 is inclined as shown in FIG. 3, the right-hand jack 12*a* is contracted to tense the rod connected thereto, and the left-hand jack 12*b* is expanded to slacken the rod connected thereto. As a result, the inclination of the machine 1 is eliminated, and the machine 1 is straightened as shown in FIG. 4. The agreement in the measurement values by the inclination measuring instruments 14, 14' provided on the upper and lower portions of the support cylinder 8 indicates that the machine 1 is being moved straight. When the machine 1 in operation is inclined, the jacks 12*a*, 12*b* are expanded or contracted to deflect the machine 1 in a proper direction to thereby eliminate the inclination thereof. Thus, the machine 2 can be inserted into the soft ground as the inclination, if any, thereof is eliminated, to harden the soft ground accurately.

Figure 5:
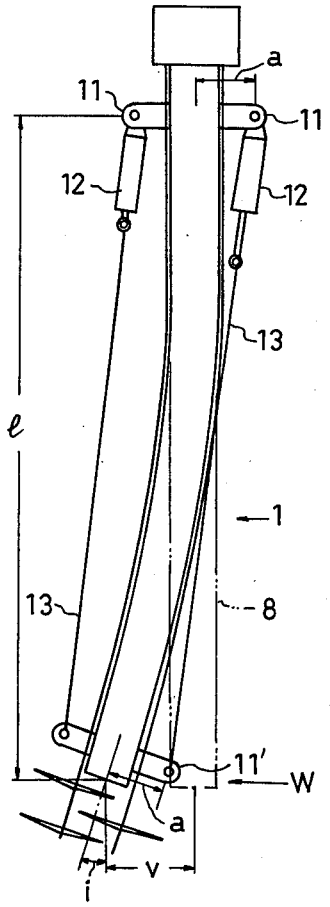
FIG. 5 is a front elevational view of the soft ground hardening machine, illustrating a method of calculating the rigidity thereof.

The rigidity of the above-described machine 1 with respect to the bending force applied thereto during an operation for eliminating the inclination thereof will be discussed with reference to FIG. 5. Let EI (wherein E is Young's modulus; and I is principal moment of inertia of area of support cylinder 8) equal the rigidity of the support cylinder 8. Assuming that the upper portion of the machine 1 having a length l is immovable with a lateral load W applied to the lower portion thereof, an amount of deflection v and an angle of inclination i of the lower portion are:

$$v = Wl^3/3EI \quad (1),$$

and $$i = Wl^2/2EI \quad (2).$$

An amount of deflection and an angle of inclination of the lower portion in the case where the jack 12 is operated to tense the rod connected thereto, and generate the force P are:

$$v = Pal^2/2EI \quad (3),$$

and $$i = Pal/EI \quad (4),$$

(wherein a is a distance between the axis of the support cylinder 8 and the free end of the bracket 11). The "P" may be substituted by any value. The power P of the jack 12 required to reduce the angle of inclination of the machine 1, which is expressed by the formula (2), to zero will be determined by way of example. On the basis of the formulae (2) and (4), $$Pal/EI = Wl^2/2EI,$$

and $$P = Wl/2a \quad (5).$$

The amount of deflection v in the above case may be determined by substituting the formula (5) for the formula (3):

$$v = Pal^2/2EI = Wl^3/4EI$$

Therefore, the lower portion of the support cylinder 8 deflected by $Wl^3/3EI$ is returned by $Wl^3/4EI$, and $$v = Wl^3/3EI - Wl^3/4EI = Wl^3/12EL \quad (6).$$

This shows that the deflection is reduced to $\frac{1}{4}$ of the original deflection, and that the rigidity of the support cylinder 8 is increased by four times.

Thus, when the machine 1 is tensed by the rods provided between the upper and lower portions thereof, the rigidity of the machine 1 can be apparently increased. Accordingly, the machine 1 is hard to be bent, and can be inserted into the soft ground as it is kept straight.

According to the soft ground hardening machine and method of the present invention, the inclination of the lower end portion of the machine can be eliminated by operating the jacks joined to the connecting means provided between the upper and lower portions of the machine. Therefore, the machine can be inserted into the soft ground as it is kept straight, and the accuracy of hardening the soft ground can be improved.

Since the insertion direction control unit consisting of jacks and rods is provided between the upper and lower portions of the machine, the rigidity of the machine with respect to the bending force applied thereto can be increased. As a result, the machine is not inclined or bent easily, so that a soft ground hardening operation can be carried out at an increased accuracy.

The present invention is not, of course, limited to the above-described embodiments; it may be modified in many other ways within the scope of the appended claims.

What is claimed is:

1. A machine for hardening the soft ground in depths, having elongated agitation shafts provided with agitation vanes at lower portions thereof and fastened rotatably to an elongated support cylinder, a rotary driving means to which the upper ends of said agitation shafts are connected, and a hardener supply unit adapted to discharge a hardener in the vicinity of said agitation vanes, comprising suitable pairs of brackets provided on the outer circumferential surfaces of upper and lower end portions of said support cylinder so as to project outward therefrom, and connecting means for joining together via jacks said pairs of brackets each pair of which are vertically opposed to each other, said jacks being adapted to be expanded and contracted so as to correct the direction in which a lower end portion of said machine is inserted into the soft ground.

2. A machine according to claim 1, wherein said connecting means having said jacks being provided on four sides, i.e. front, rear, right and left sides, of said support cylinder.

3. A machine according to claim 1, wherein said machine includes inclination measuring instruments provided on upper and lower portions of said support cylinder in such a manner that said measuring instruments are opposed to said connecting means.

4. A method of hardening the soft ground in depths by using a machine for hardening such ground having elongated agitation shafts provided rotatably around the outer circumferential surface of an elongated support cylinder, wherein the soft ground and a hardener discharged from said machine thereinto are mixed with each other with vanes provided at lower portions of said agitation shafts, to harden the soft ground, comprising the steps of detecting an angle of inclination of said machine while said machine is inserted into and withdrawn from the soft ground, and tensing or slackening, when said machine is inclined, connecting means, which are provided between upper and lower portions of said support cylinder, by means of jacks so as to eliminate the inclination of said machine.

5. A method according to claim 4, wherein said step of detecting an angle of inclination of said machine while said machine is inserted into and withdrawn from the soft ground is carried out by means of inclination measuring instruments provided on said support cylinder.

* * * * *